US012330196B2

(12) United States Patent
Klein

(10) Patent No.: US 12,330,196 B2
(45) Date of Patent: Jun. 17, 2025

(54) CONTINUOUSLY OPERABLE PRODUCTION PLANT AND METHOD FOR OPERATING THE PRODUCTION PLANT WHEN THERE IS A FAULT

(71) Applicant: SMS Group GmbH, Duesseldorf (DE)

(72) Inventor: Christoph Klein, Kreuztal (DE)

(73) Assignee: SMS Group GmbH, Duesseldorf (DE)

( * ) Notice: Subject to any disclaimer, the term of this patent is extended or adjusted under 35 U.S.C. 154(b) by 1226 days.

(21) Appl. No.: 16/330,414

(22) PCT Filed: Aug. 22, 2017

(86) PCT No.: PCT/EP2017/071087
§ 371 (c)(1),
(2) Date: Mar. 5, 2019

(87) PCT Pub. No.: WO2018/041661
PCT Pub. Date: Mar. 8, 2018

(65) Prior Publication Data

US 2021/0283668 A1 Sep. 16, 2021

(30) Foreign Application Priority Data

Sep. 5, 2016 (DE) ..... 102016216727.8

(51) Int. Cl.
*B21B 1/46* (2006.01)
*B21B 15/00* (2006.01)
*B21B 39/00* (2006.01)

(52) U.S. Cl.
CPC ..... *B21B 1/463* (2013.01); *B21B 15/0007* (2013.01); *B21B 39/004* (2013.01)

(58) Field of Classification Search
CPC ..... B22D 11/148; B22D 11/163; B21B 1/463
See application file for complete search history.

(56) References Cited

U.S. PATENT DOCUMENTS 5,771,560 A * 6/1998 Meroni ..... B22D 11/1206 164/476
2004/0096299 A1 5/2004 Sudau
(Continued)

FOREIGN PATENT DOCUMENTS

CN 101848780 A 9/2010
CN 102240674 A 11/2011
(Continued)

OTHER PUBLICATIONS

Second Office Action from corresponding Chinese Patent Application No. 201780054175.2, dated Jun. 17, 2020.

*Primary Examiner* — Kevin E Yoon
*Assistant Examiner* — Jacky Yuen
(74) *Attorney, Agent, or Firm* — Amster, Rothstein & Ebenstein LLP

(57) ABSTRACT

In the case of a production plant which comprises in series a thin-slab continuous casting plant (1), which is arranged upstream of a roller hearth furnace (2), the roller hearth furnace (2) and a rolling mill (3), which is arranged downstream of the roller hearth furnace (2) and has an assigned reeling plant (21), wherein the continuous casting plant (1) and the rolling mill (3) can be operated in a continuous operating mode, the intention is to provide a solution that allows a slab buffer capacity to be provided for a continuously operated thin slab continuous casting plant when there is a fault causing a standstill in the transport of the slab or strip. This is achieved by the production plant having four slab or strip cutting devices (10, 14, 17, 24), which are arranged upstream and downstream of the roller hearth furnace (2), in a section along the length of the roller hearth furnace (2) and on the outlet side of a first separate roll line (12) of the rolling mill (3).

7 Claims, 1 Drawing Sheet

(56) References Cited

U.S. PATENT DOCUMENTS

| | | | | |
|---|---|---|---|---|
| 2010/0147484 | A1 | 6/2010 | Rosenthal | |
| 2011/0272116 | A1* | 11/2011 | Benedetti | B21B 1/46 164/424 |
| 2011/0308757 | A1* | 12/2011 | Benedetti | B21B 39/004 164/471 |
| 2011/0315340 | A1 | 12/2011 | Benedetti | |

FOREIGN PATENT DOCUMENTS

| | | | |
|---|---|---|---|
| CN | 102294357 | A | 12/2011 |
| JP | 0441048 | | 2/1992 |

* cited by examiner

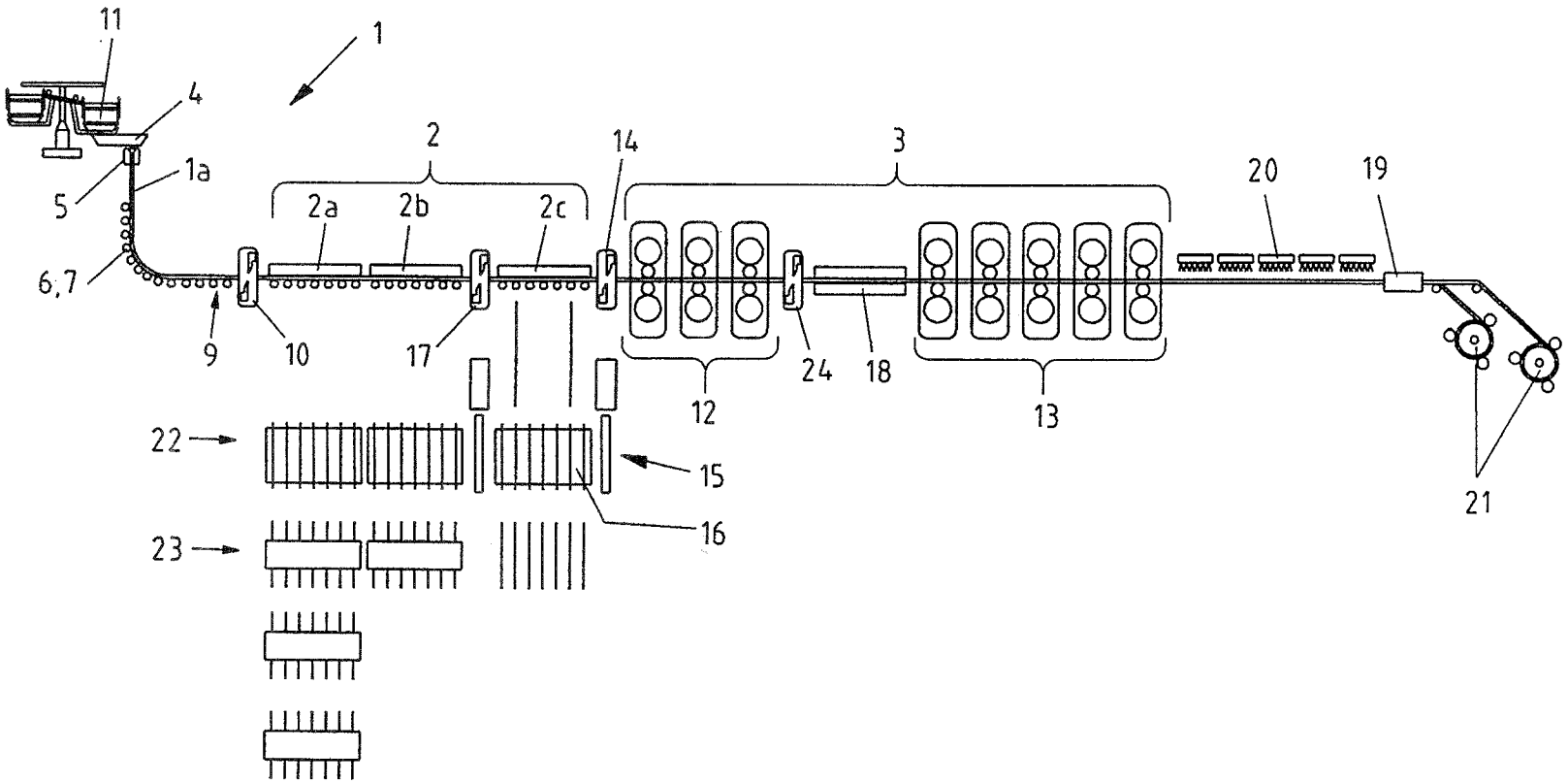
1
2
2a
2b
2c
3
4
5
6,7
9
10
11
12
13
14
15
16
17
18
19
20
21
22
23
24
1a

CONTINUOUSLY OPERABLE PRODUCTION PLANT AND METHOD FOR OPERATING THE PRODUCTION PLANT WHEN THERE IS A FAULT

RELATED APPLICATIONS

The present application is a National Stage application of International application PCT/EP2017/071087 filed Aug. 22, 2017 and claiming priority of German Application DE 10 2016 216 727.8 filed Sep. 5, 2016, both applications are incorporated herein by reference thereto.

The invention relates to a production plant having arranged in a row one after another, a thin slab continuous casting machine, a roller hearth furnace for receiving a cast strand or at least one cut-off section of the cast strand, a rolling mill for rolling the cast strand or the cut-off section thereof that was heated or kept warm in the roller hearth furnace, and a coiler associated therewith.

The invention further relates to a method of operating a such production plant.

Production plants which have in their production line, arranged in a row one after another, a continuous casting machine, a roller hearth furnace, and then a rolling mill with an associated coiler, are known as thin slab casting and rolling plants which are referred to as CSP-plants or as CEM (Compact Endless Cast and Rolling mills). Such plants can be continuously operated for a continuous production of rolled metal strips. During the continuous production cast thin slabs are continuously transported to the roller hearth furnace and the rolling mill. The problem with the continuous operation consists in a "rigid" connection between the continuous casting machine and the rolling mill, wherein the temperature in the entire plant, in particular in the finishing rolling mill cannot always be kept at a necessary level in a continuous process dependent on a casting speed.

Therefore, such plants have been modified further to make a batch operation possible in which by separation of a cast thin slab, decoupling between the casting machine/caster and the rolling mill and, thus, the discontinuous production of the metal strip becomes possible.

DE 10 2008 020 412 A1 discloses such production plant. In addition to arranged in a row production plant components, casting machine, roller hearth furnace, and rolling mill, this plant has two slab or strip separation or cutting devices as well as furnace ferry system. In the production line, the thin slab strand is transported to a first rolling stand of the rolling mill that is followed by a first slab or strip separating or cutting device. The purpose of a furnace is to heat the slab after it has been cut to a uniform temperature. Then, the slab is drawn into the rolling mill with a greater speed than the cast speed. This is followed by the furnace ferry system that is followed by a roller hearth system with a slab or strip cutting device located upstream of a second stand group of the rolling mill. With this production, it is possible to move slabs out of the line for storage or to temporarily store them.

In a continuous operation, such handling of a thin slab is not possible. This results in that in case of an accident that causes stoppage of the slab transportation, loading of the furnace ferry of the furnace ferry system is not possible because already a too long slab section remains in the roller hearth furnace.

Such a production plant but without a furnace ferry system is disclosed in EP 2957 359A1.

The object of the invention is to provide a solution that would allow to provide a slab buffer capacity in a continuously operated thin slab production plant in case of a standstill in the slab or strip transportation caused by an accident.

This object is achieved with a production plant and a method according to the claims.

According to the invention, there is a production plant comprising, arranged in a row one after another, a thin slab continuous casting machine, a roller hearth furnace for receiving a cast strand or at least one cut-off section of the cast strand, a rolling mill for rolling the cast strand or the cut-off section thereof that was heated or kept warm in the roller hearth furnace, and an associated coiler, wherein the continuous casting machine and the rolling mill are operable in a continuous operating mode, and wherein the roller hearth furnace is associated with a furnace ferry system arranged laterally with respect to the roller hearth furnace, and the rolling mill has a first stand group, a second stand group, and a heating device, in particular an induction heating device provided between the first and second stand groups, and wherein upstream of the roller hearth furnace in displacement direction of the slab, there is provided first slab or strip cutting device, in particular strip cutting shears, preferably pendulum shears, and at an outlet side, in the slab displacement direction, of the roller hearth furnace and upstream of the first stand group of the rolling mill, there is provided second slab or strip cutting device, wherein the second slab or strip cutting device is formed as a flame cutting device, and wherein in an outlet region of the roller hearth furnace, preferably in an elongate section of the roller hearth furnace having a length corresponding to a longitudinal extent of the furnace ferry, a third slab or strip cutting device formed as a flame cutting device, is provided and on an outlet side, in the strip displacement direction, of the first stand group of the rolling mill upstream of the heating device, a fourth slab and strip cutting device, in particular strip shears, preferably drum shears, is provided.

The inventive method of operating the production plan proposes that at a standstill of a slab or strip transportation during an accident in the production plant, all of the first through fourth slab or strip cutting devices are activated, and the thin slab or at least a cut-of section thereof and the strip are cut-off at respective positions of the first through fourth slab or strip cutting devices.

The inventive production plant is also characterized by arrangement and positioning of the four slab or strip cutting devices which are arranged, respectively, in front of roller hearth furnace, in the roller hearth furnace, after the roller hearth furnace, and in front of the first stand of the rolling mill, after the first stand of the rolling mill and in front of the second stand of the rolling mill. Thereby, in case of an accident when the thin slab or strip transportation is interrupted, it becomes possible to cut the slab or the strip at these positions, at this, two of the four slab or strip cutting devices, namely, the first and fourth cutting devices which are formed as strip shears, provide for or make possible to cut-off to-be-removable waste pieces. Both of the other devices, namely, the second and third slab or strip cutting devices which are formed as flame cutting devices, enable cutting of a gap between remaining slab pieces and, thus, provide for reciprocation of the remaining slab pieces in the roller hearth furnace during the accident.

Thus, according to the invention, it is important to arrange all of the four slab and strip cutting devices at predetermined positions and insure their activation in case of a standstill of the slab or strip transportation in case of an accident in the production plant.

In a further addition and development of the production plant, the invention contemplates association of the furnace ferry system with a roller table and a stack-forming device following the roller table. This makes it possible to remove cut-off pieces from the roller hearth furnace with one or more furnace ferry (ies) and to delivery them to the stack-forming device over the roller table in case the duration of the accident is so long that it exceeds the maximum allowable staying time of slab (in the roller hearth furnace-translator's remark). In this respect, the method according to the invention contemplates that in case the maximum allowable staying time of the slab is exceeded, the cut-off pieces are removed sidewise with the furnace ferry and are delivered by the roller table to the following it, stack-forming device.

According to the advantages embodiment of the inventive, the waste pieces are cut-off with the first and fourth slab or strip cutting devices and are removed from the production line of the production plant.

Finally, the inventive method is characterized in that, the second and third slab or strip cutting devices cut-off such length of the thing slab or at least a cut-off section thereof or the strip that a remaining partial length of the thin slab would be able to reciprocate back and forth in the roller hearth furnace for duration of the accident.

The inventionis explained in more detail below by way of example with reference to a single figure. The figure schematically shows the arrangement of various parts of the production plant in a production line of the production plant according to the invention.

The figure shows a schematic side view of a production plant formed as a continuous casting and rolling installation including a thin-slab continuous casting installation or a thin-slab continuous casting machine 1 for producing a cast strand 1*a*, a roller hearth furnace 2, and a rolling mill 3 with associated auxiliary equipment.

These components of the thin-slab continuous casting plant or a thin-slab continuous casting machine 1 are arranged in a row one after another and form the production line of the thin-slab continuous casting plant or the continuous casting machine 1.

In the continuous casting machine 1 which is located upstream of the roller hearth furnace 2, there are provided a cast pan 11 from which a tundish 4 is fed and which is followed by a continuous casting mold 5, support roller frame 6 with a bending section 7, and a straightening machine. At the outlet 9 of the thin-slab continuous casting installation or the continuous casting machine 1, there is provided, in the slab displacement direction, upstream of the roller hearth furnace 2, a first slab or strip cutter 10 in form of a pendulum shears.

The rolling mill 3 begins after second slab or strip cutting device 14 which is located in the slab displacement direction, downstream of the roller hearth furnace 2 and in front of a first stand group 12 of the rolling mill 3 and is formed as a flame cutting device or a flame cutter. Thereafter, the first stand group 12 of the rolling mill 3 follows, and which is followed by a second stand group 13, spaced from the first stand group 12, a heating device 18, in particular, an induction heating device located between the first and second stand groups 12, 13. After the second stand group 13, there are provided, in conventional manner, a cutting device 19, a cooling zone 20, and two coilers 21. In the rolling mill 3 which is located downstream of the roller hearth furnace 2, a cast strand 1 a that was heated in the roller hearth furnace 2 or was kept warm, or a cut-off, by a first slab or strip cutting device 10, length section is rolled.

The roller hearth furnace 2, which receives the cast strand or a cut-off length section thereof, is divided in three equal sections 2*a*, 2*b*, and 2*c* and is formed for receiving a predetermined thin-slab length or a cut-off length section of the cast strand 1*a*. The outlet side of the roller hearth furnace is associated with a laterally arranged furnace ferry system 15 that includes a furnace ferry 16 in the region of the last third of the roller hearth system and with which the length sections of a thin slab, which were separated in the roller hearth furnace 2, can be removed sidewise of the roller hearth system. In order to be able to cut such length sections, there is provided, in the outlet region of the roller hearth furnace 2 in a longitudinal section of the roller hearth furnace 2 corresponding to about longitudinal extent of the furnace ferry 16, a third slab or strip cutting device 17. This third slab or strip cutting device is likewise formed as a flame cutting device or a flame cutter and is located, viewed in a transportation direction of the roller hearth furnace 2 or in the direction of the slab or strip displacement, in the rear region of the roller hearth furnace in front of the furnace ferry 16.

A roller table 22 with a following stack-forming device 23 is associated with the furnace ferry system 15.

A fourth slab or strip cutting device 24 is located, in the strip displacement direction, on the outlet side of the first stand group 12 of the rolling mill 3 and in front of the inlet of the heating device 18. The fourth slab or strip cutting device 24 is formed as drum shears.

The production plant is used for continuous rolling or batch rolling by casting liquid metal, in particular steel, into a cast strand 1*a* that after its solidification, is divided into cast strand sections by the first slab or strip cutting device 10 and is transported into the roller hearth furnace 2. The respective cast strand sections are heated to a uniform temperature in the roller hearth furnace 2 and are transported at a rolling temperature to the rolling mill 3 for rolling. During this time, continuous casting takes place without interruption.

If an accident occurs at which transportation of the slab or strip is interrupted, the first through fourth slab or strip cutting devices 10, 14, 17, 24 are available and provide, due to their interaction, for use of the roller hearth furnace 2 as a slab buffer capacity.

When in the case of an accident, the separation of the cast strand 1*a* into cast strand sections is interrupted, all of the four (from first to fourth) slab or strip cutting devices 10, 14, 17, and 24 are activated, and the thin slab is separated at four positions each corresponding to a respective position of one of the slab or strip cutting devices. Here, the first and fourth slab or strip cutting devices 10, 24 which are formed as strip shears, cut off, respectively, scrap pieces which are then disposed of by removing the scrap.

Further, a gap between respective head and tail of the slab sections is formed at the interfaces of each of the second and third slab or strip cutting devices 14 and 17 which are formed as flame cutting devices, so that the slab sections can be reciprocated back and forth in the roller hearth furnace for some time.

In case the accident cannot be eliminated within a time period that is defined as a maximum slab-staying time in the furnace, it still would be possible to roll the slab sections which remain in the roller hearth furnace 2, in the rolling mill 3, with these slab sections being transferred by the furnace ferry 16 sidewise from the roller hearth furnace 2 and over the roller table 22 to the stack-forming device 23 and be disposed in this way.

The second slab or strip cutting device 14 which is formed as a flame cutting device, anyway prevents that a slab section having a length greater than a simple slab length, is forwarded to the rolling mill 3. It is important to prevent this because the high-speed shears (the cutting device 19) that are arranged in front of a reel or coiler 21, are designed for continuous operation for cutting strips with a thickness smaller than 4 mm.

In case of disposal of extra-long stabs from the roller hearth furnace 2, these shears must be activated for cutting them to a coil length. After an accident, the maximum strip thickness cannot be guaranteed.

LIST OF REFERENCE NUMERALS

1 Thin-slab continuous casting plant
1*a* Cast strand
2 Roller hearth furnace
3 Rolling mill
10 Slab or Strip cutting device
12 First stand group
13 Second stand group
14 Slab or Strip Cutting device
15 Furnace ferry system
16 Furnace ferry
17 Slab or strip cutting device
18 Heating device
21 Coiler
22 Roller Table
23 Staple-forming device
24 Slab or strip cutting device

The invention claimed is:

1. A method of operating a production plant including, arranged in a row one after another to define a production line for forming a thin slab or strip, a thin slab continuous casting machine, a roller hearth furnace for receiving therein a cast strand or at least one cut-off section of the cast strand which forms the thin slab, a rolling mill for rolling the cast strand or the at least one cut-off section thereof that was heated or kept warm within the roller hearth furnace, and an associated coiler, wherein the continuous casting machine and the rolling mill are operated in a continuous endless operating mode along the production line;

wherein the roller hearth furnace is associated with a furnace ferry system which is arranged laterally off-line with respect to the roller hearth furnace and the production line, and the rolling mill has a first roller stand group, a second roller stand group, and a heating device provided between the first roller stand group and the second roller stand group;

wherein upstream of the roller hearth furnace in a displacement direction of the thin slab or strip along the production line, there is provided a first slab or strip cutting device, and at an outlet side, in the thin slab or strip displacement direction, of the roller hearth furnace and upstream of the first roller stand group of the rolling mill-, there is provided a second slab or strip cutting device, the second slab or strip cutting device being a flame cutting device;

wherein in an outlet region of the roller hearth furnace, in front of an elongate section of the roller hearth furnace corresponding to a longitudinal extent of a furnace ferry of the furnace ferry system, is provided a third slab or strip cutting device formed as a flame cutting device, which is positioned in front of a length section of the roller hearth furnace that corresponds to a longitudinal extension of the furnace ferry system, wherein on an outlet side, in the thin slab or strip displacement direction of the first roller stand group of the rolling mill and upstream of the heating device, is provided a fourth slab or strip cutting device, the method comprising:

activating, at a standstill of a slab or strip transportation during an accident in the production plant while being operated in the continuous endless operating mode, all of the first through fourth slab or strip cutting devices which are arranged along the row forming the production line of the production plant;

contemporaneously cutting off the thin slab or at least a cut-off section thereof and the strip at respective positions of the activated first through fourth slab or strip cutting devices along the production line, such that a length of the thin slab or at least a cut-off section thereof is formed between the second and third slab or strip cutting devices within the roller hearth furnace; and laterally removing from the production line, via the furnace ferry system, the length of the thin slab or at least the cut-off section thereof within the roller hearth furnace to a site displaced from the production line, such that a gap is formed where the length of the thin slab or at least cut-off section thereof was removed within the roller hearth furnace between the second and third slab or strip cutting devices.

2. The method according to claim 1, wherein the contemporaneously cutting off step, with respect to the first and fourth slab or strip cutting devices, includes cutting off and removal of waste pieces from the production line of the production plant.

3. The method according to claim 1 further comprising a step of reciprocating a remaining partial length of the thin slab back and forth within a space formed at least by the gap within the roller hearth furnace for a predetermined duration of the accident.

4. The method according to claim 1, wherein the production plant further comprises a roller table that, together with a stack-forming device, is associated with the furnace ferry system, the method further comprising:

laterally transporting the at least one cut-off section with the furnace ferry system, which is arranged lateral to the roller hearth furnace, such that the at least one cut-off section moves along the roller table toward the stack-forming device when a maximum allowable staying time of the thin slab in the roller hearth furnace is exceeded.

5. The method according to claim 1 further comprising providing an induction heating device between the first and second roller stand groups as the heating device.

6. The method according to claim 1 further comprising providing strip cutting shears or pendulum shears as the first slab or strip cutting device.

7. The method according to claim 1 further comprising providing strip cutting shears or drum shears as the fourth slab or strip cutting device.

* * * * *